US009553405B2

(12) United States Patent
Chen et al.

(10) Patent No.: US 9,553,405 B2
(45) Date of Patent: Jan. 24, 2017

(54) POSITIONING STRUCTURE AND CONNECTOR ASSEMBLY

(71) Applicant: Wistron Corporation, New Taipei (TW)

(72) Inventors: Hung-Sheng Chen, New Taipei (TW); Jian-Shiang Juang, New Taipei (TW)

(73) Assignee: WISTRON CORPORATION, New Taipei (TW)

( * ) Notice: Subject to any disclaimer, the term of this patent is extended or adjusted under 35 U.S.C. 154(b) by 0 days.

(21) Appl. No.: 14/715,224

(22) Filed: May 18, 2015

(65) Prior Publication Data

US 2016/0020554 A1 Jan. 21, 2016

(30) Foreign Application Priority Data

Jul. 17, 2014 (TW) ..... 103124645 A

(51) Int. Cl.
*H01R 13/629* (2006.01)
*H01R 13/631* (2006.01)
(Continued)

(52) U.S. Cl.
CPC ..... *H01R 13/631* (2013.01); *H01R 12/91* (2013.01); *H01R 13/629* (2013.01);
(Continued)

(58) Field of Classification Search
CPC ..... H01R 13/629; H01R 13/631; H01R 13/73; H01R 13/74; H01R 13/743; H01R 13/745
(Continued)

(56) References Cited

U.S. PATENT DOCUMENTS 4,626,052 A * 12/1986 Rumble ..... H01R 31/06 439/173
5,431,580 A * 7/1995 Tabata ..... H01R 13/4532 439/188
(Continued)

FOREIGN PATENT DOCUMENTS

TW I248714 B 2/2006
TW 200845511 A 11/2008
TW 200906011 A 2/2009

OTHER PUBLICATIONS

Taiwanese Office Action dated Apr. 20, 2016, as issued in corresponding Taiwan Patent Application No. 103124645 with partial English translation (9 pages).

*Primary Examiner* — Amy Cohen Johnson
*Assistant Examiner* — Oscar C Jimenez
(74) *Attorney, Agent, or Firm* — Muncy, Geissler, Olds & Lowe, P.C.

(57) ABSTRACT

A positioning structure is applied to a male end connector and a female end connector. The female end connector has an inserting slot and two guiding slots. The positioning structure has a case, two guiding pins, two elastic parts, and a positioning member. The two guiding pins are connected to the case. The male end connector is located between the two guiding pins. The elastic parts are connected to the case and to the male end connector. The positioning member has a first positioning hole and two second positioning holes. The first positioning hole is used for the male end connector passing through to enter the inserting slot. The second positioning holes are used for the guiding pin passing through to enter the guiding slot.

21 Claims, 10 Drawing Sheets

(51) Int. Cl.
*H01R 12/91* (2011.01)
*H01R 24/60* (2011.01)
*H01R 107/00* (2006.01)

(52) U.S. Cl.
CPC ..... *H01R 13/6315* (2013.01); *H01R 24/60* (2013.01); *H01R 2107/00* (2013.01)

(58) Field of Classification Search
USPC ..... 439/247, 248, 374, 78, 680
See application file for complete search history.

(56) References Cited

U.S. PATENT DOCUMENTS

| | | | | |
|---|---|---|---|---|
| 7,445,479 | B2 | 11/2008 | Fan et al. | |
| 7,458,837 | B2 * | 12/2008 | Mineo | G01R 1/0416 324/756.05 |
| 7,508,658 | B2 | 3/2009 | Ling | |
| 8,644,018 | B2 | 2/2014 | Hung | |
| 8,790,127 | B1 * | 7/2014 | Wilkolaski | H01R 13/6453 439/378 |
| 2013/0309886 | A1 * | 11/2013 | Tiberghien | F16L 37/56 439/191 |

* cited by examiner

POSITIONING STRUCTURE AND CONNECTOR ASSEMBLY

BACKGROUND OF THE INVENTION

1. Field of the Invention

The present invention relates to a positioning structure; more particularly, the present invention relates to a positioning structure for adjusting the connecting position of the male end connector and the female end connector.

2. Description of the Related Art

In modern society, the computer is ubiquitous in daily life. The common computer has a female main slot, which can connect to an external device with a male connector such as a USB memory device, an external connecting station, or a mouse; therefore, the computer can work with many kinds of external devices via the connection between the female main slot and the male connector to provide various application modes.

However, in the structure of the female main slot, there is usually an assembly tolerance; also, the male connectors of the external devices, which are produced by different manufacturers, usually have different assembly tolerances. Therefore, when the female main slot connects to the male connector of an external device, because of the differences in those assembly tolerances, the connecting position of the female main slot and the male connector can easily tilt, become loose, be excessively tight, be poorly positioned, or even be unable to connect.

Therefore, there is a need to provide a new connecting structure design that can provide the function of adjusting the position of the female main slot and the male connector such that the female main slot and the male connector can be connected smoothly.

SUMMARY OF THE INVENTION

It is an object of the present invention to provide a positioning structure for adjusting the connecting position of a male end connector and a female end connector.

To achieve the abovementioned object, the positioning structure of the present invention is applied to a male end connector and a female end connector. The female end connector includes an inserting slot and two guiding slots. The positioning structure includes a case, two guiding pins, two elastic parts and a positioning member. The two guiding pins are connected to the case, and the male end connector is located between the two guiding pins. The two elastic parts are connected to the case and to the male end connector. The positioning member includes a first positioning hole and two second positioning holes. The first positioning hole is used for the male end connector passing through to enter the inserting slot. The two second positioning holes are respectively used for each guiding pin passing through to enter each guiding slot.

According to one embodiment of the present invention, the positioning member further includes two positioning projections, and the two positioning projections are located near the first positioning hole.

According to one embodiment of the present invention, the positioning member is connected to the case.

According to one embodiment of the present invention, the positioning member is connected to the female end connector.

According to one embodiment of the present invention, the guiding pin further includes a guiding portion; the guiding portion is used for guiding the male end connector when the guiding pin passes through the second positioning hole.

According to one embodiment of the present invention, the first positioning hole is located between the two second positioning holes.

According to one embodiment of the present invention, the case further includes two supporting guiding structures, and the two supporting guiding structures are respectively connected to the two elastic parts.

According to one embodiment of the present invention, the two supporting guiding structures are used for guiding the male end connector to move along a guiding direction; the male end connector moves along a pushing direction to connect to the female end connector, and the guiding direction is perpendicular to the pushing direction.

According to one embodiment of the present invention, when the male end connector is located in the inserting slot and the guiding pin is located in the guiding slot, a first distance is formed between the guiding pin and the guiding slot, a second distance is formed between the male end connector and the inserting slot, a third distance is formed between the guiding pin and the second positioning hole, and a fourth distance is formed between the male end connector and the first positioning hole, wherein a sum of the third distance and the fourth distance is less than a sum of the first distance and the second distance.

According to one embodiment of the present invention, the third distance is less than the fourth distance, the fourth distance is less than the first distance, and the first distance is less than the second distance.

Another object of the present invention is to provide a connector assembly for adjusting a position of the male end connector and a position of the female end connector.

To achieve the abovementioned object, the connector assembly of the present invention includes a male end connector, a female end connector, and a positioning structure. The female end connector includes an inserting slot and two guiding slots. The positioning structure includes a case, two guiding pins, two elastic parts and a positioning member. The two guiding pins are connected to the case, and the male end connector is located between the two guiding pins. The two elastic parts are connected to the case and to the male end connector. The positioning member includes a first positioning hole and two second positioning holes. The first positioning hole is used for the male end connector passing through to enter the inserting slot. The two second positioning holes are respectively used for each guiding pin passing through to enter each guiding slot.

DETAILED DESCRIPTION OF THE PREFERRED EMBODIMENT

These and other objects and advantages of the present invention will become apparent from the following description of the accompanying drawings, which disclose several embodiments of the present invention. It is to be understood that the drawings are to be used for purposes of illustration only, and not as a definition of the invention.

Figure 1:
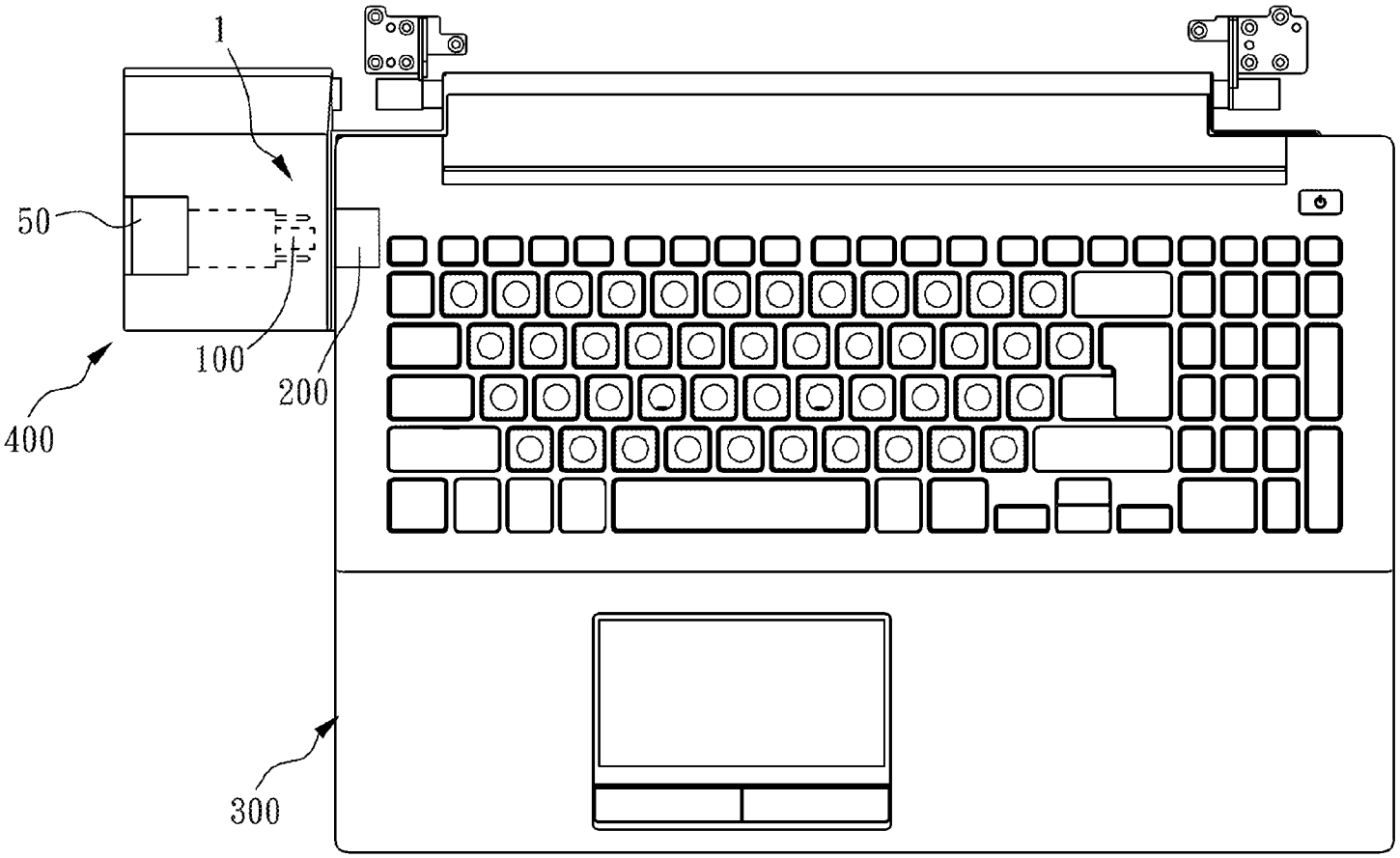
FIG. 1 illustrates a schematic drawing of the electronic device and the external device of the first embodiment of the present invention.
Figure 2:
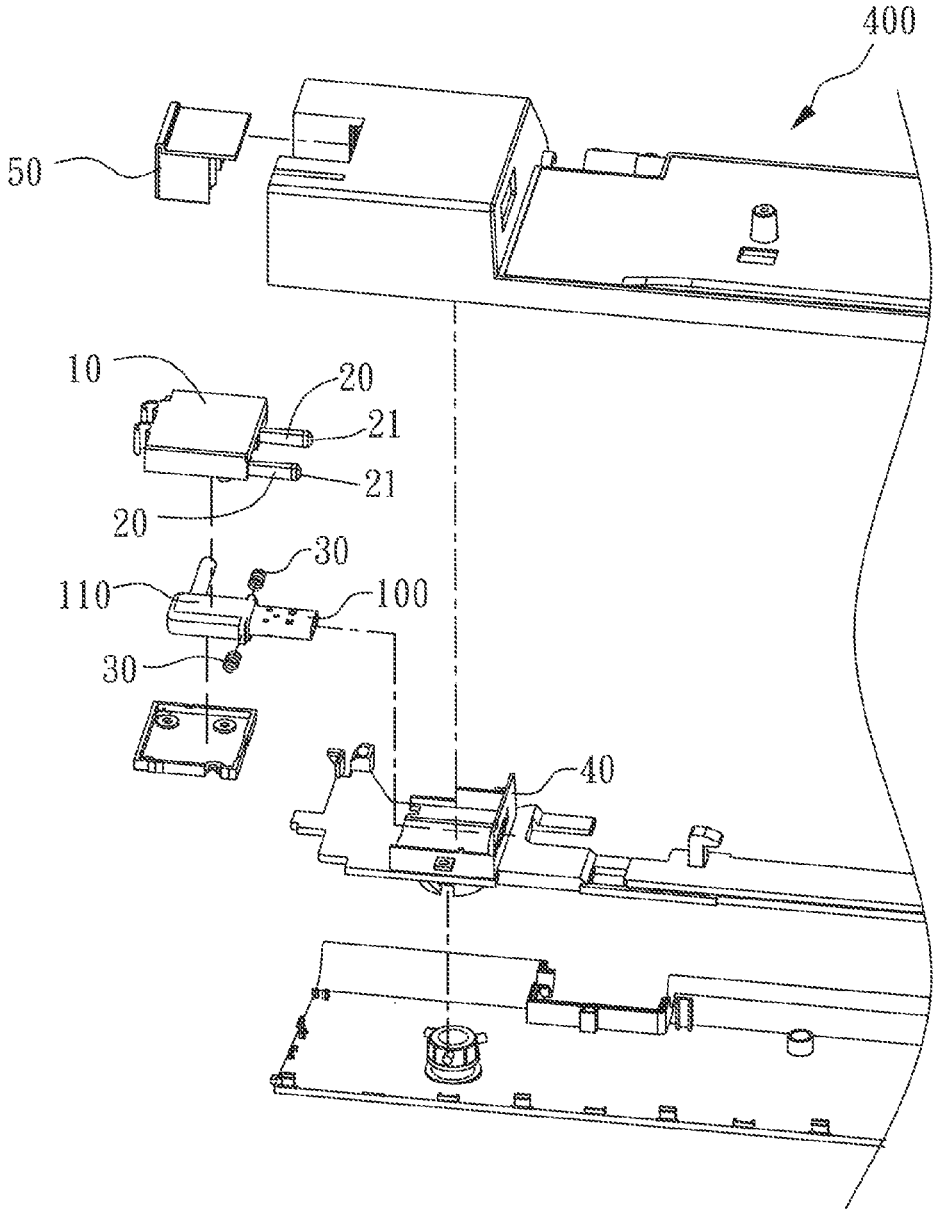
FIG. 2 illustrates an exploded perspective view of the external device of the first embodiment of the present invention.
Figure 3:
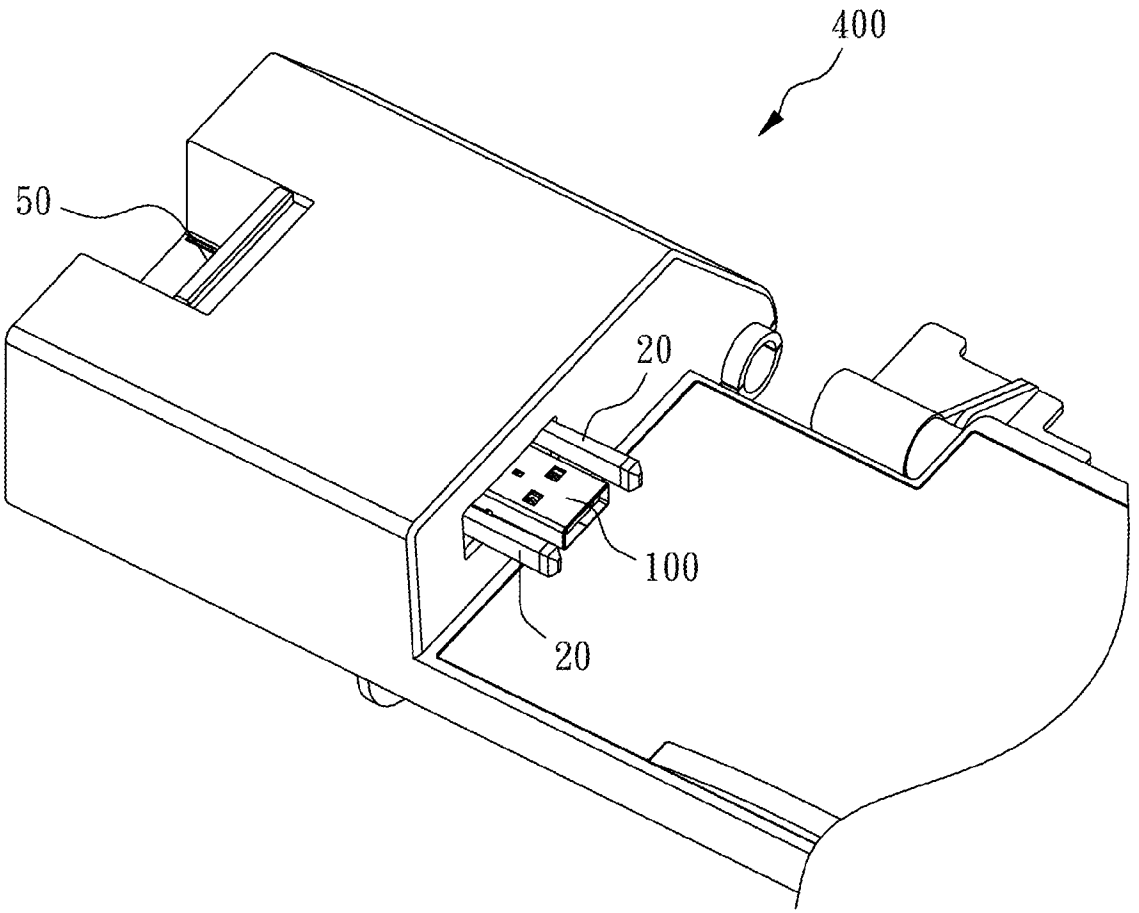
FIG. 3 illustrates a schematic drawing of the external device of the first embodiment of the present invention.
Figure 4:
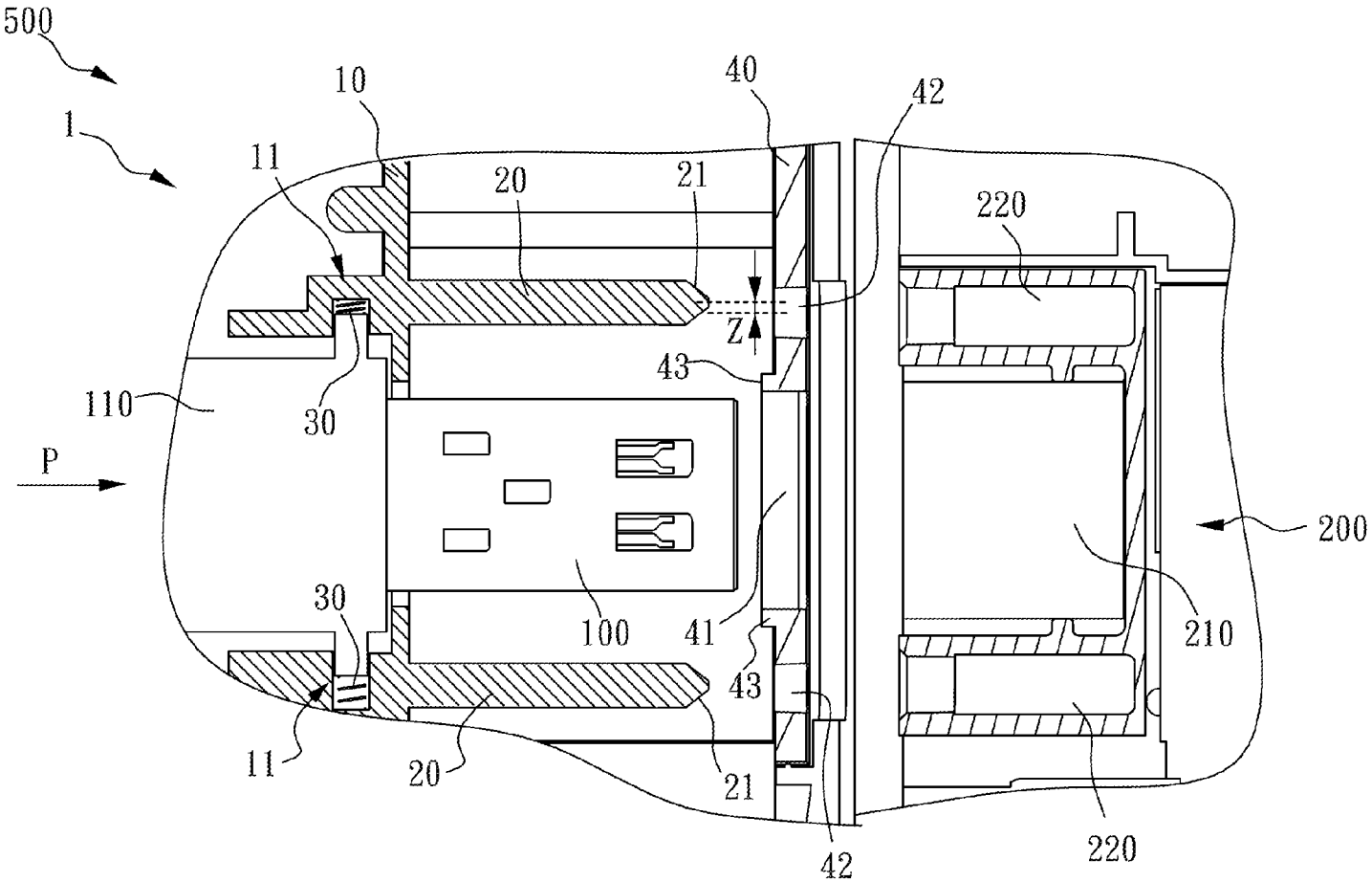
FIG. 4 illustrates a schematic drawing of the positioning structure, the male end connector and the female end connector of the first embodiment of the present invention.
Figure 4A:
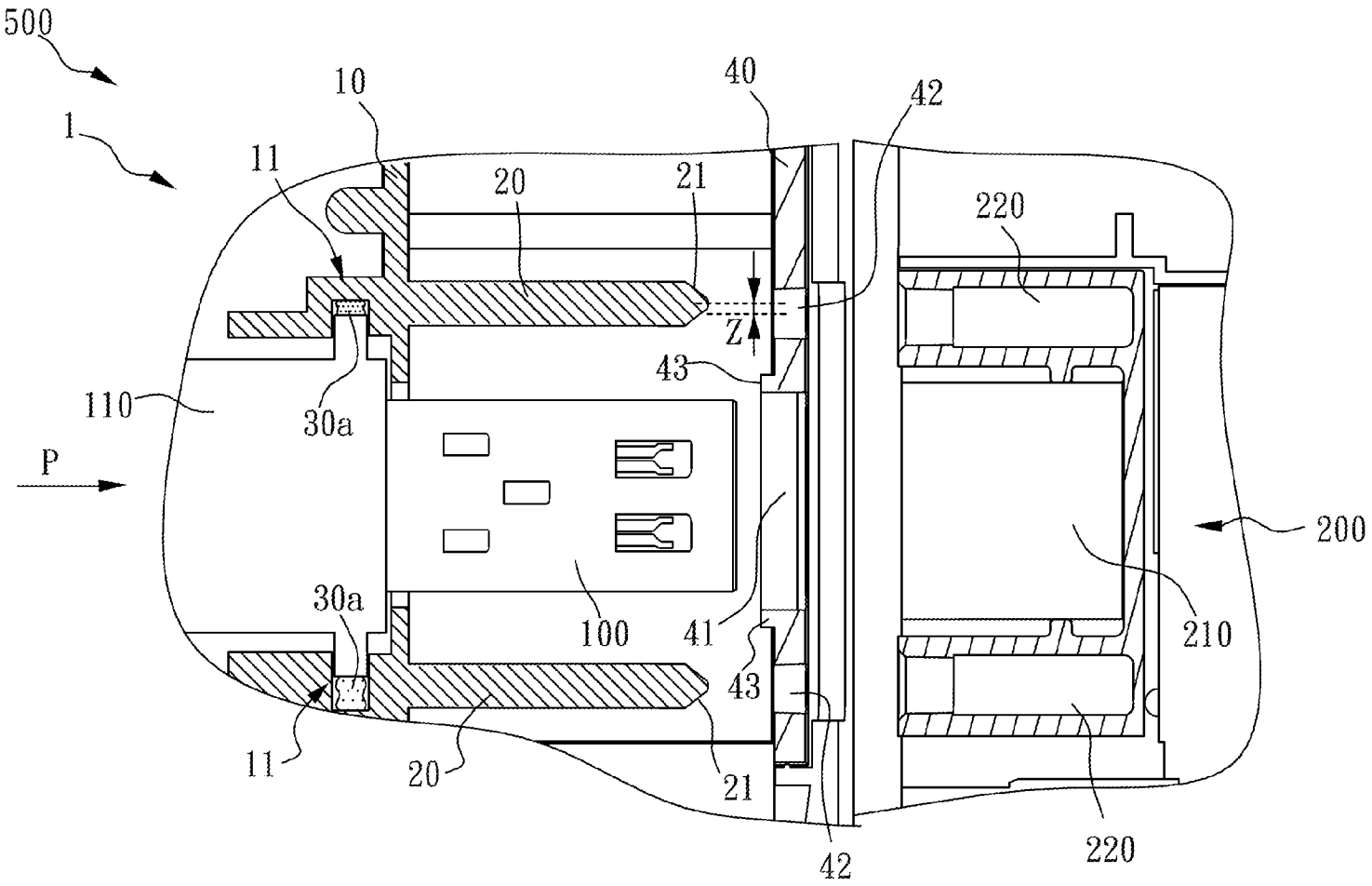
FIG. 4*a* illustrates a schematic drawing of the positioning structure, the male end connector and the female end connector of the first embodiment of the present invention.
Figure 5:
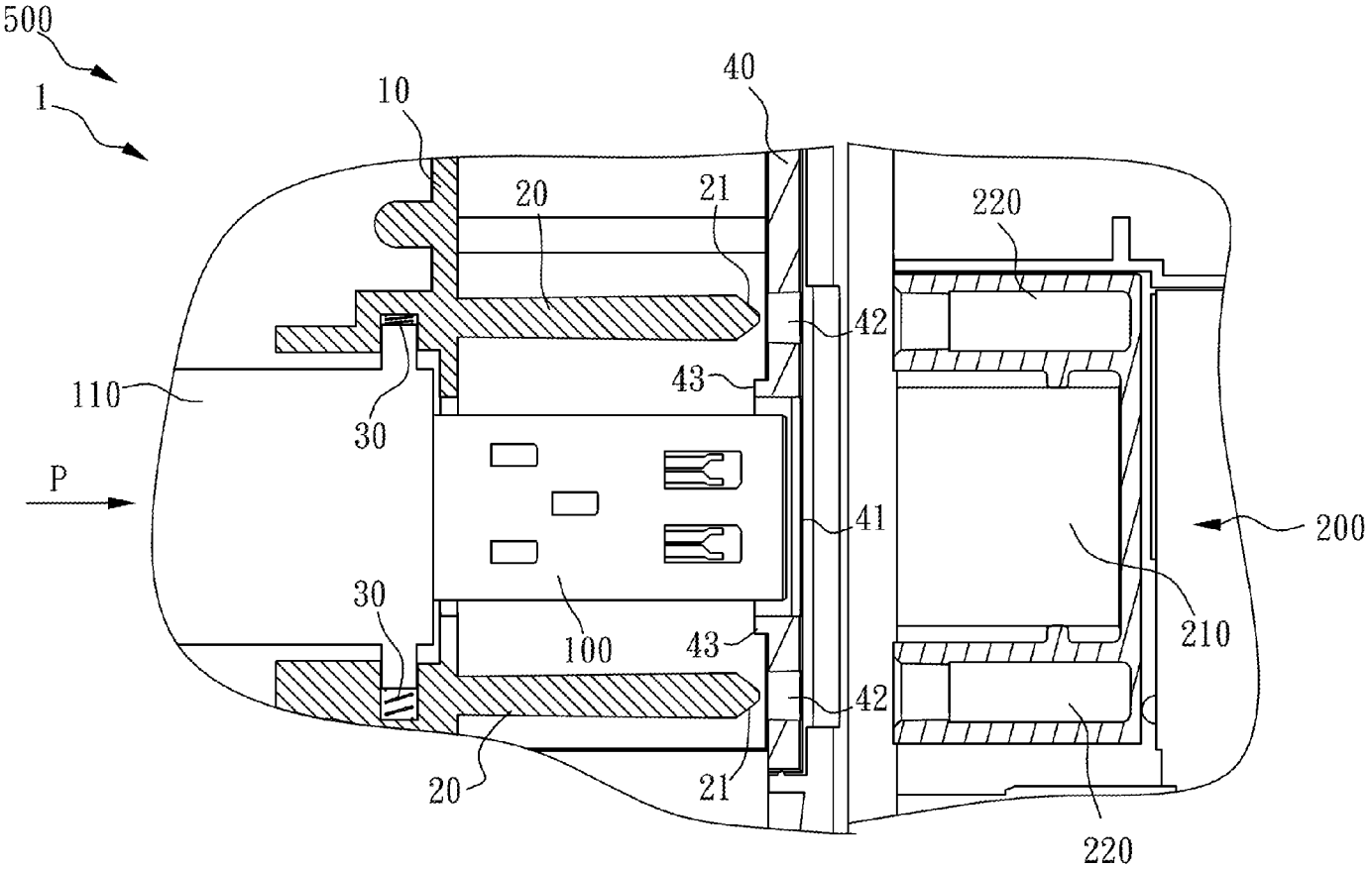
FIG. 5 illustrates a schematic drawing of the male end connector when entering the first positioning hole of the first embodiment of the present invention.
Figure 6:
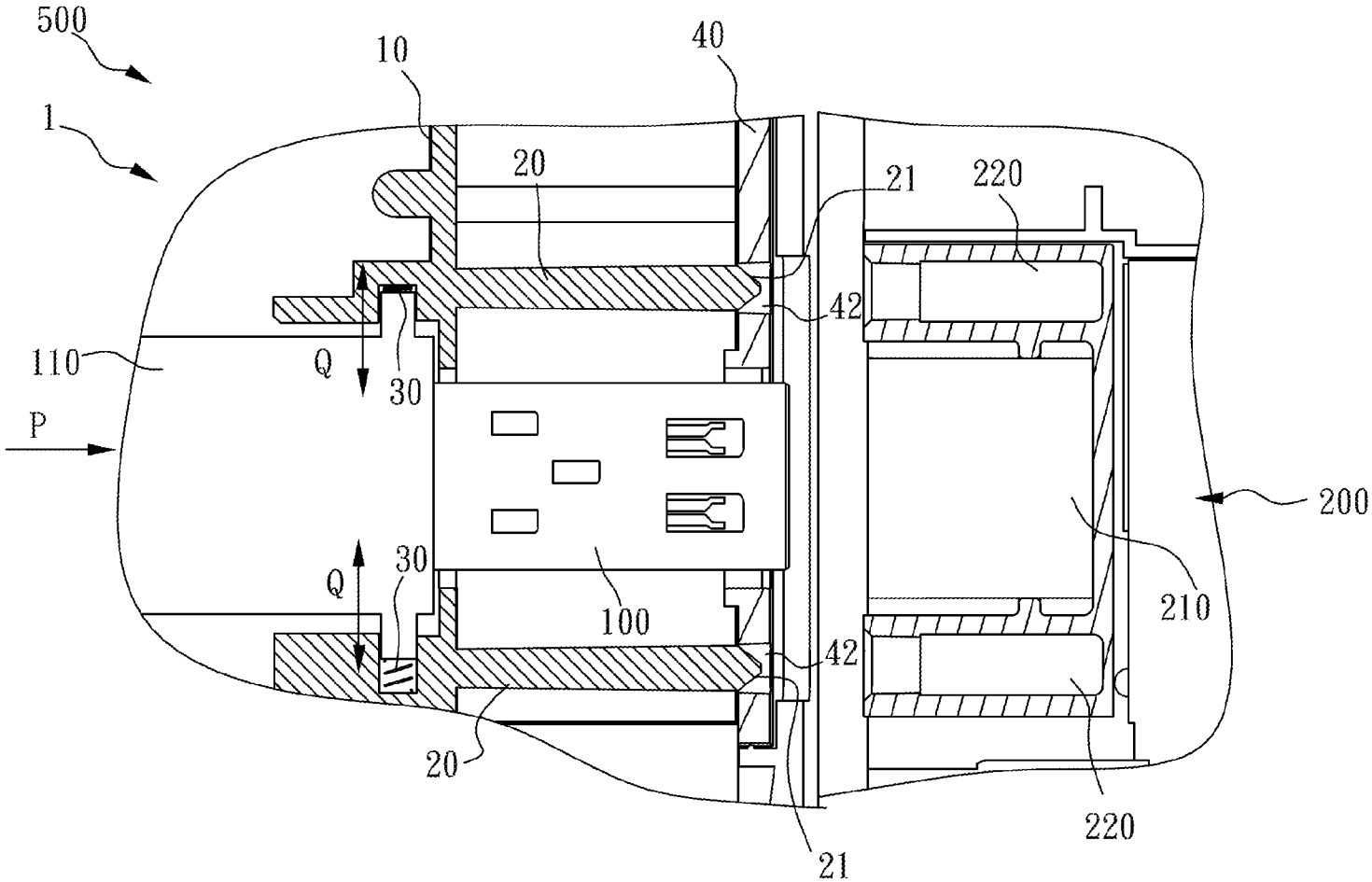
FIG. 6 illustrates a schematic drawing of the guiding pin when entering the second positioning hole of the first embodiment of the present invention.
Figure 7:
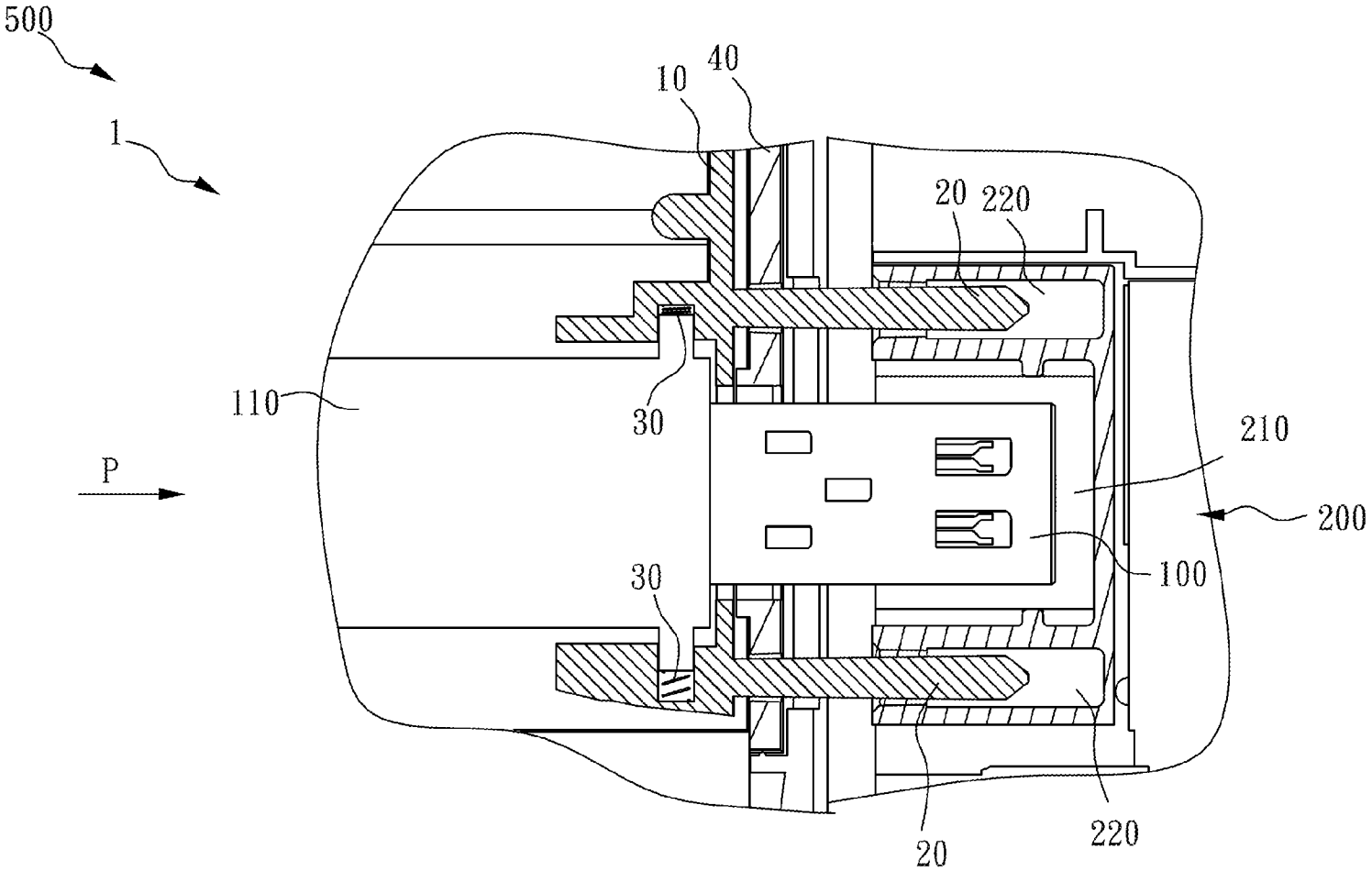
FIG. 7 illustrates a schematic drawing of the male end connector connected to the female end connector of the first embodiment of the present invention.
Figure 8:
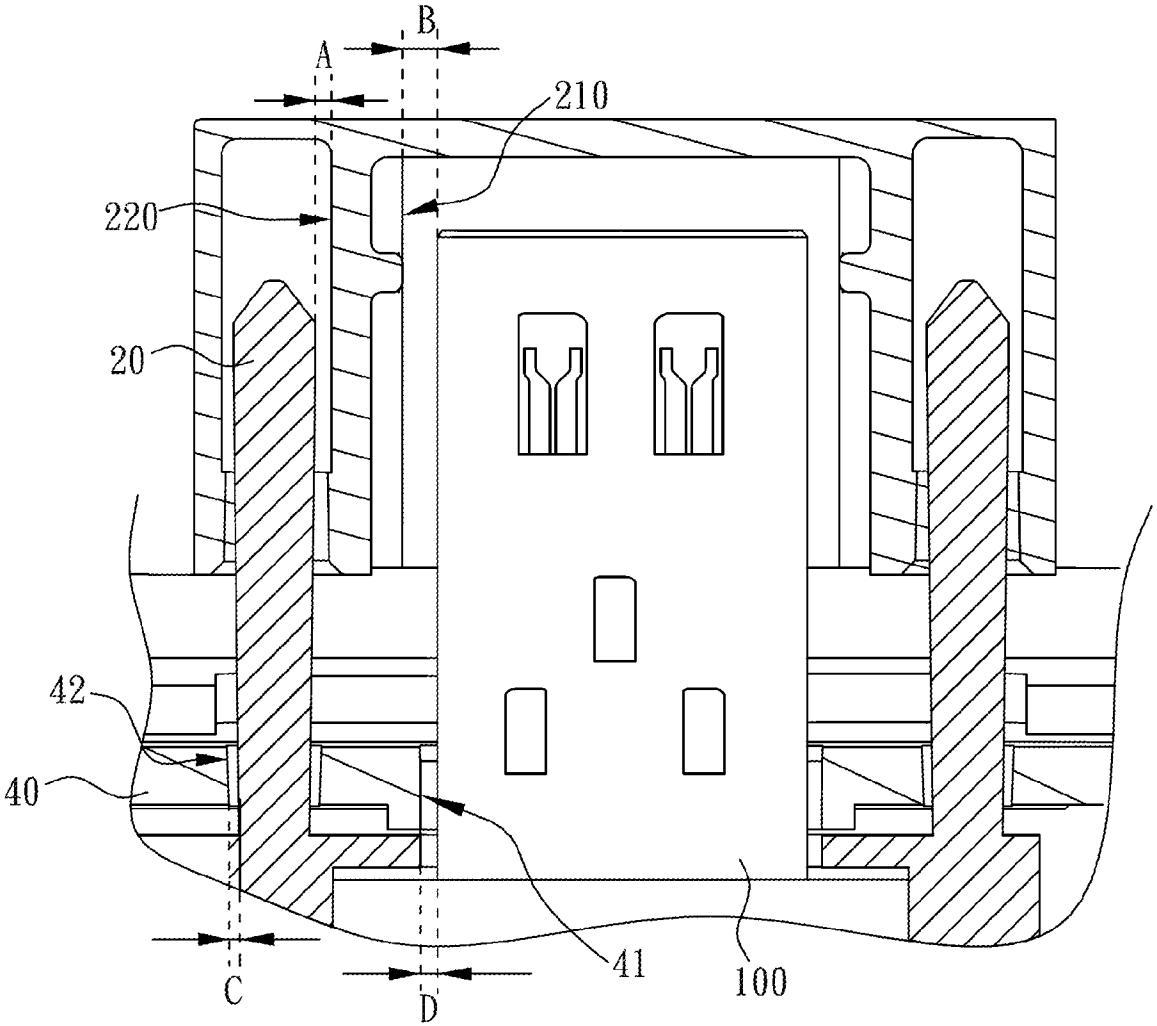
FIG. 8 illustrates a schematic drawing of the first distance, the second distance, the third distance and the fourth distance of the first embodiment of the present invention.

Please refer to FIG. 1 to FIG. 8, which illustrate the positioning structure of the first embodiment of the present invention. FIG. 1 illustrates a schematic drawing of the electronic device and the external device of the first embodiment of the present invention. FIG. 2 illustrates an exploded perspective view of the external device of the first embodiment of the present invention. FIG. 3 illustrates a schematic drawing of the external device of the first embodiment of the present invention. FIG. 4 illustrates a schematic drawing of the positioning structure, the male end connector and the female end connector of the first embodiment of the present invention. FIG. 4*a* illustrates a schematic drawing of the positioning structure, the male end connector and the female end connector of the first embodiment of the present invention. FIG. 5 illustrates a schematic drawing of the male end connector when entering the first positioning hole of the first embodiment of the present invention. FIG. 6 illustrates a schematic drawing of the guiding pin when entering the second positioning hole of the first embodiment of the present invention. FIG. 7 illustrates a schematic drawing of the male end connector connected to the female end connector of the first embodiment of the present invention. FIG. 8 illustrates a schematic drawing of the first distance, the second distance, the third distance and the fourth distance of the first embodiment of the present invention.

As shown in FIG. 1, FIG. 2 and FIG. 4, in the first embodiment of the present invention, the connector assembly 500 of the present invention includes a male end connector 100, a female end connector 200 and a positioning structure 1. The female end connector 200 is installed in an electronic device 300, and the male end connector 100 is installed in an external device 400. The male end connector 100 of the present embodiment is a movable structure that can move along a pushing direction P and pass through the hole of the external device 400 to connect to the female end connector 200 installed in the electronic device 300. The male end connector 100 includes a main body 110 for containing the electronic circuit of the male end connector 100. The electronic device 300 can be a notebook computer; the external device 400 can be a multifunction docking station for connecting to the notebook computer, allowing the connecting notebook to use the additional transmission port of the multifunction docking station of the external device 400; however, the type of the electronic device 300 and the external device 400 are not limited to that application; for example, the external device 400 can also be a mouse, a USB disk, or an external hard disk. The positioning structure 1 of the present invention is applied to the male end connector 100 and the female end connector 200 for adjusting the position of the male end connector 100 when the male end connector 100 is connected to the female end connector 200, allowing the male end connector 100 to align with the female end connector 200 accurately to complete the connection smoothly.

As shown in FIG. 4 and FIG. 6, in the first embodiment of the present invention, the female end connector 200 includes an inserting slot 210 and two guiding slots 220; the inserting slot 210 is located between the two guiding slots 220, and the inserting slot 210 is used for connecting to the male end connector 100. As shown in FIG. 2 to FIG. 4, the positioning structure 1 includes a case 10, two guiding pins 20, two elastic parts 30, a positioning member 40, and a pushing part 50. The case 10 includes two supporting guiding structures 11. The two supporting guiding structures 11 are respectively connected to two elastic parts 30 and hold the two sides of the main body 110 of the male end connector 100; the two supporting guiding structures 11 are used for guiding the male end connector 100 to move along a guiding direction Q, and the guiding direction Q is perpendicular to the pushing direction P; whereby, the supporting guiding structure 11 can limit the moving direction of the male end connector 100, allowing the position of the main body 110 to be stable to prevent the main body 110 from tilting when pushed by the elastic part 30. The two guiding pins 20 are connected to the case 10, and the male end connector 100 is located between the two guiding pins 20. The positions of two guiding pins 20 are respectively corresponded to the two guiding slots 220, and the guiding pin 20 is used for plugging the guiding slot 220 to provide the function of adjusting the position. Each guiding pin 20 includes a guiding portion 21; the guiding portion 21 is used for guiding the case 10 to move to push the elastic part 30 when the guiding pin 20 passes through the positioning member 40, allowing the elastic part 30 to apply force to the male end connector 100. Two elastic parts 30 are connected to the case 10 and to the two sides of the main body 110 of the male end connector 100; the type of the elastic part 30 can be a spring, as shown in FIG. 4, or a sponge, illustrated as the elastic part 30*a* shown in FIG. 4*a*, or another object with elastic force.

In the first embodiment of the present invention, the positioning member 40 can be connected to the case 10 via the connecting method of glue pasting, screw locking, or hook fastening. The positioning member 40, which is shaped as a plate structure, includes a first positioning hole 41, two second positioning holes 42, and two positioning projections 43. The position of the first positioning hole 41 is corresponded to the inserting slot 210; the first positioning hole 41 is used for the male end connector 100 passing through to enter the inserting slot 210. The positions of the two second positioning holes 42 are respectively corresponded to two guiding slots 220; the second positioning holes 42 are respectively used for allowing each guiding pin 20 to pass through to enter each guiding slot 220 and provide the function of adjusting the position. Two positioning projections 43 are located near the first positioning hole 41. The pushing part 50 is exposed to the outsides of the external device 400; the pushing part 50 is used for the user applying force to push the male end connector 100 to pass through the positioning member 40.

As shown in FIG. 4 and FIG. 8, in the first embodiment of the present invention, when the male end connector 100 is located in the inserting slot 210 and the guiding pin 20 is located in the guiding slot 220, a first distance A is formed between the guiding pin 20 and the guiding slot 220, a second distance B is formed between the male end connector 100 and the inserting slot 210, a third distance C is formed between the guiding pin 20 and the second positioning hole 42, and a fourth distance D is formed between the male end connector 100 and the first positioning hole 41. The first distance A of the present invention is the design gap between the guiding pin 20 and the guiding slot 220, the second distance B is the design gap between the male end connector 100 and the inserting slot 210, the third distance C is the reserve design gap between the guiding pin 20 and the second positioning hole 42, and the fourth distance D is the reserve design gap between the male end connector 100 and the first positioning hole 41. The third distance C and the fourth distance D are used as the buffer space for the guiding pin 20 and the male end connector 100 when the displacement deviation is being adjusted. Via the design of the third distance C and the fourth distance D, during the process of adjusting the displacement, the guiding pin 20 and the male end connector 100 move partially to a distance equal to the third distance C and the fourth distance D; however, if the range of the third distance C and fourth distance D is too large, the guiding pin 20 and the male end connector 100 may be displaced too much, interfering with the entrance of the guiding pin 20 and the male end connector 100 to the second positioning hole 42 and the first positioning hole 41. Therefore, the sum of the third distance C and the fourth distance D of the present invention is designed to be less than the sum of the first distance A and the second distance B; also, the third distance C is less than the fourth distance D, the fourth distance D is less than the first distance A, and the first distance A is less than the second distance B; whereby, the size of the third distance C and the fourth distance D can be limited to a suitable range, allowing the guiding pin 20 and the male end connector 100 to move appropriately; therefore, when the male end connector 100 plugs into the inserting slot 210, the guiding pin 20 can appropriately adjust the position of the male end connector 100 to align with the inserting slot 210 to provide a positioning adjustment function.

When the user wants to plug the male end connector 100 into the female end connector 200, as shown in FIG. 3 to FIG. 5, the user can push the pushing part 50 to cause the male end connector 100 to move along the pushing direction P and towards the positioning member 40 and the female end connector 200. As shown in FIG. 4, in the first embodiment, when the male end connector 100 does not contact the positioning member 40, the guiding pin 20 must move for a displacement distance Z to plug into the second positioning hole 42, wherein the displacement distance Z is the distance between the central axis of the guiding pin 20 and the central axis of the second positioning hole 42; therefore, when the guiding pin 20 moves smoothly such that the central axis of the guiding pin 20 aligns with the central axis of the second positioning hole 42 (which means that the displacement distance Z is zero), the guiding pin 20 can plug into the second positioning hole 42 smoothly. Then, as shown in FIG. 5, when the user continues to push, causing the male end connector 100 to enter the first positioning hole 41, the two positioning projections 43 near the first positioning hole 41 can limit the movement of the male end connector 100, causing the male end connector 100 to align with the female end connector 200 roughly, and the guiding portion 21 of the guiding pin 20 can slide along the outer edge of the second positioning hole 42; therefore, the guiding pin 20 can move properly to eliminate the difference of the displacement distance Z to smoothly enter the second positioning hole 42; meanwhile, the moving guiding pin 20 guides the case 10 to move such that the case 10 pushes the elastic part 30. Therefore, as shown in FIG. 6, the male end connector 100 located between the two elastic parts 30 is pushed by the elastic force of the elastic part 30 such that the male end connector is adjusted to a suitable position in order to smoothly pass through the first positioning hole 41 to enter the female end connector 200.

As shown in FIG. 7 and FIG. 8, because the third distance C is less than the fourth distance D, the fourth distance D is less than the first distance A, the first distance A is less than the second distance B, and the sum of the third distance C and the fourth distance D is less than the sum of the first distance A and the second distance B, the moving distance of the guiding pin 20 and the male end connector 100 in the second positioning hole 42 and first positioning hole 41 is less than either the distance between the guiding pin 20 and the guiding slot 220 or the distance between the male end connector 100 and the inserting slot 210. As shown in FIG. 4 and FIG. 8, before the male end connector 100 plugs into the female end connector 200, the difference of the displacement distance Z must be eliminated; because the design gap of the third distance C is reserved between the guiding pin 20 and the second positioning hole 42, therefore, when the guiding portion 21 of the guiding pin 20 slides into the second positioning hole 42, the guiding pin 20 will move for a distance equal to the third distance C, and at this moment, the difference of (Z−C) will be eliminated; meanwhile, the male end connector 100 will also follow the guiding pin 20 to move, and the displacement distance of the male end connector 100 will equal the third distance C. Then, because the design gap of the fourth distance D is reserved between the male end connector 100 and the first positioning hole 41, when the male end connector 100 enters the first positioning hole 41, the male end connector 100 will also move for a distance equal to the fourth distance D, and the difference [(Z−C)−D] is thus eliminated. Because the difference is eliminated [(Z−C)−D], and the third distance C and the fourth distance D are used as the buffer space for adjusting the displacement tilting of the guiding pin 20 and the male end connector 100, the third distance C and the fourth distance D have the function of eliminating the difference; therefore, the total amount of the difference to be eliminated is [(Z−C)−D]+C+D=Z, which means that the difference of the displacement distance Z can be completely eliminated by the positioning structure 1 of the present invention. Furthermore, because the range of the third distance C and the fourth distance D is limited by the conditions that the sum of the third distance C and the fourth distance D is less than the sum of the first distance A and the second distance B, and the third distance C is less than the fourth distance D, the fourth distance D is less than the first distance A, and the first distance A is less than the second distance B, it follows that the range of the third distance C and the fourth distance D will not be too large to prevent the need for the guiding pin 20 and the male end connector 100 to be adjusted in response to the displacement tilting. Therefore, when the guiding pin 20 and the male end connector 100 are affected by the second positioning hole 42 and the first positioning hole 41, via the abovementioned relation design between the first distance A, the second distance B, the third distance C and the fourth distance D, the displacement distance generated by the guiding pin 20 and the male end connector 100 will be limited to a proper range, allowing the guiding pin 20 and the male end connector 100 to smoothly enter the guiding slot 220 and the inserting slot 210. Therefore, via the design of the positioning structure 1 of the present invention, the user can apply force to the positioning structure 1 to push the male end connector 100 to cause the male end connector 100 to be adjusted for positioning by the positioning structure 1 when moving to smoothly and accurately align with the inserting slot 210 of the female end connector 200 for completion of the connection.

Figure 9:
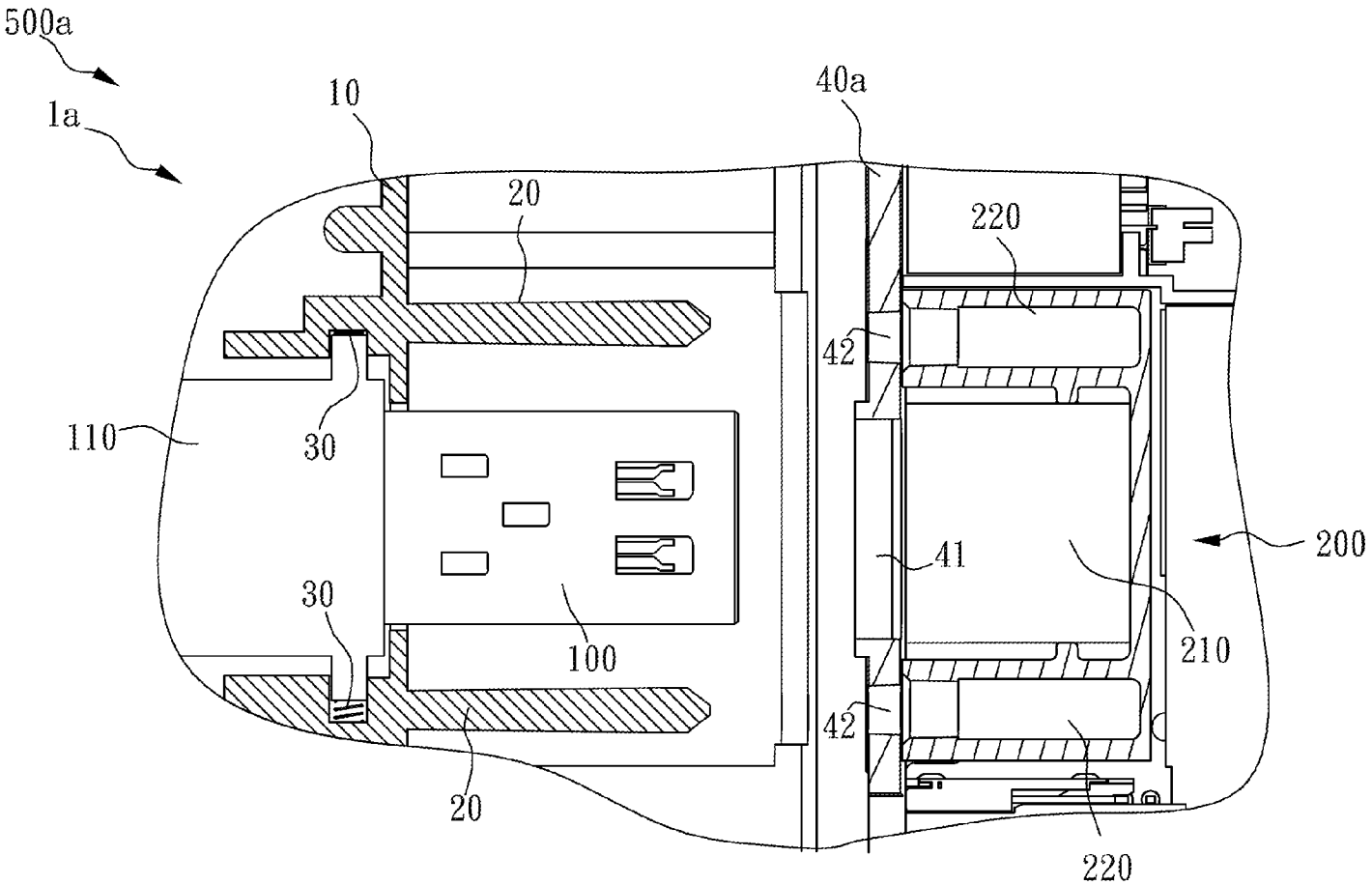
FIG. 9 illustrates a schematic drawing of the positioning structure, the male end connector and the female end connector of the second embodiment of the present invention.

Please refer to FIG. 9, which illustrates the positioning structure of the second embodiment of the present invention. FIG. 9 illustrates a schematic drawing of the positioning structure, the male end connector and the female end connector of the second embodiment of the present invention.

As shown in FIG. 9, the difference between the second embodiment and the first embodiment of the present invention is that the positioning member 40*a* of the second embodiment is not connected to the case 10, and the positioning member 40*a* of the second embodiment is connected to the female end connector 200. When the male end connector 100 and the guiding pin 20 touch the positioning member 40*a*, the first positioning hole 41 and the second positioning hole 42 of the positioning member 40*a* can work with the elastic part 30 to adjust the position of the male end connector 100 and the guiding pin 20 such that the male end connector 100 and the guiding pin 20 can respectively connect to the inserting slot 210 and the guiding slot 220.

Via the design of the positioning structure 1 of the connector assembly 500 of the present invention, the user can apply force to the positioning structure 1 easily to push the male end connector 100 to move towards the female end connector 200. During the moving of the male end connector 100, the positioning structure 1 can adjust the position of the male end connector 100 such the male end connector 100 smoothly and accurately connects to the inserting slot 210 of the female end connector 200.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A positioning structure, applied to a male end connector and a female end, connector, wherein the female end connector comprises an inserting slot and two guiding slots, the male end connector enters the inserting slot along a pushing direction, the positioning structure comprising:

a case;

two guiding pins, connected to the case, wherein the male end connector is located between the two guiding pins;

two elastic parts, directly connected to the case and the male end connector, wherein the two elastic parts are used for directly pushing the male end connector along a guiding direction, the guiding direction is perpendicular to the pushing direction; and a positioning member, comprising:

a first positioning hole, for the male end connector passing through to enter the inserting slot; and two second positioning holes, respectively used for each guiding pin passing through to enter each guiding slot.

2. The positioning structure as claimed in claim 1, wherein the positioning member further comprises two positioning projections, and the two positioning projections are located near the first positioning hole.

3. The positioning structure as claimed in claim 2, wherein the positioning member is connected to the case.

4. The positioning structure as claimed in claim 3, wherein the guiding pin further comprises a guiding portion and the guiding portion is used for guiding the male end connector when the guiding pin passes through the second positioning hole.

5. The positioning structure as claimed in claim 4, wherein the first positioning hole is located between the two second positioning holes.

6. The positioning structure as claimed in claim 5, wherein the case further comprises two supporting guiding structures, and the two supporting guiding structures are respectively connected to the two elastic parts.

7. The positioning structure as claimed in claim 6, wherein the two supporting guiding structures are used for guiding the male end connector to move along the guiding direction; the male end connector moves along the pushing direction to connect the female end connector.

8. The positioning structure as claimed in claim 7, wherein when the male end connector is located in the inserting slot and the guiding pin is located in the guiding slot, a first distance is formed between the guiding pin and the guiding slot, a second distance is formed between the male end connector and the inserting slot, a third distance is formed between the guiding pin and the second positioning hole, and a fourth distance is formed between the male end connector and the first positioning hole, wherein a sum of the third distance and the fourth distance is less than a sum of the first distance and the second distance.

9. The positioning structure as claimed in claim 8, wherein the third distance is less than the fourth distance, the fourth distance is less than the first distance, and the first distance is less than the second distance.

10. The positioning structure as claimed in claim 2, wherein the positioning member is connected to the female end connector.

11. The positioning structure as claimed in claim 10, wherein the guiding pin further comprises a guiding portion, and the guiding portion is used for guiding the male end connector when the guiding pin passes through the second positioning hole.

12. A connector assembly, comprising:

a male end connector;

a female end connector, comprising an inserting slot and two guiding slots, wherein the male end connector enters the inserting slot along a pushing direction; and a positioning structure, comprising:

a case;

two guiding pins, connected to the case, wherein the male end connector is located between the two guiding pins;

two elastic parts, directly connected to the case and the male end connector, wherein the two elastic parts are used for directly pushing the male end connector along a guiding direction, the guiding direction is perpendicular to the pushing direction; and a positioning member, comprising:

a first positioning hole, used for the male end connector passing through to enter the inserting slot; and two second positioning holes, respectively used for each guiding pin passing through to enter each guiding slot.

13. The connector assembly as claimed in claim 12, wherein the positioning member further comprises two positioning projections, and the two positioning projections are located near the first positioning hole.

14. The connector assembly as claimed in claim 13, wherein the positioning member is connected to the case.

15. The connector assembly as claimed in claim 14, wherein the guiding pin further comprises a guiding portion, and the guiding portion is used for guiding the male end connector when the guiding pin passes through the second positioning hole.

16. The connector assembly as claimed in claim 15, wherein the first positioning hole is located between the two second positioning holes.

17. The connector assembly as claimed in claim 16, wherein the case further comprises two supporting guiding structures, and the two supporting guiding structures are respectively connected to the two elastic parts.

18. The connector assembly as claimed in claim 17, wherein when the male end connector is located in the inserting slot and the guiding pin is located in the guiding slot; a first distance is formed between the guiding pin and the guiding slot, a second distance is formed between the male end connector and the inserting slot, a third distance is formed between the guiding pin and the second positioning hole, and a fourth distance is formed between the male end connector and the first positioning hole, wherein a sum of the third distance and the fourth distance is less than a sum of the first distance and the second distance.

19. The connector assembly as claimed in claim 18, wherein the third distance is less than the fourth distance, the fourth distance is less than the first distance, and the first distance is less than the second distance.

20. The connector assembly as claimed in claim 13, wherein the positioning member is connected to the female end connector.

21. The connector assembly as claimed in claim 20, wherein the guiding pin further comprises a guiding portion, and the guiding portion is used for guiding the male end connector when the guiding pin passes through the second positioning hole.

* * * * *